US006231364B1

(12) United States Patent
Liu

(10) Patent No.: US 6,231,364 B1
(45) Date of Patent: May 15, 2001

(54) MEMORY MODULE CONNECTOR

(76) Inventor: Chao-Zen Liu, 3Fl-1, No.492-19, Sec. 1, Wan-Shou Rd., Kwei-Shan Hsiang, Tao-Yuan Hsien (TW)

( * ) Notice: Subject to any disclaimer, the term of this patent is extended or adjusted under 35 U.S.C. 154(b) by 0 days.

(21) Appl. No.: 09/116,305

(22) Filed: Jul. 15, 1998

(30) Foreign Application Priority Data

Jul. 19, 1997 (TW) ..... 86212102

(51) Int. Cl.[7] ..... H01R 13/62

(52) U.S. Cl. ..... 439/326; 439/570; 439/62; 439/157; 439/328; 361/801

(58) Field of Search ..... 361/801, 802, 361/740, 748, 756, 759, 747, 737; 439/325–329, 363

(56) References Cited

U.S. PATENT DOCUMENTS 5,514,002 * 5/1996 Cheng et al. ..... 439/326
5,863,213 * 1/1999 Enomoto et al. ..... 439/326

* cited by examiner

*Primary Examiner*—Jayprakash N. Gandhi
*Assistant Examiner*—Thanh Y. Tran
(74) *Attorney, Agent, or Firm*—Pro-Techtor International Services

(57) ABSTRACT

A memory module connector mounted on a mother board and adapted to receive a memory module, having two metal reinforcing members respectively fastened to two latches at two opposite ends of a connector body thereof to reinforce the structural strength of the latches for positively holding an inserted memory module in the connector body.

5 Claims, 3 Drawing Sheets

MEMORY MODULE CONNECTOR

BACKGROUND OF THE INVENTION

The present invention relates to a memory module connector installed in a mother board and adapted to receive a memory module, and more particularly to such a memory module connector which has metal reinforcing members attached to latches thereof for protection.

A regular memory module connector adapted for mounting on a mother board to receive a memory module is generally comprised of a connector body having an elongated insertion slot and two latches at two opposite ends of the insertion slot, and two rows of terminals mounted in the insertion slot at two opposite sides and respectively soldered to the mother board. When installing a memory module in the insertion slot of the connector body, the latches are respectively bent outwards for permitting the memory module to be inserted into position. After the installation of the inserted memory module in the insertion slot of the connector body, the latches automatically return to their former shape and hold down the inserted memory module. When to remove the inserted memory module from the connector body, the latches must be bent outwards. This structure of memory module connector is not durable in use because frequently bending the latches causes the latches to be broken or excessively deformed.

SUMMARY OF THE INVENTION

The present invention provides a memory module connector which eliminates the aforesaid problem. According to the preferred embodiment of the present invention, the memory module connector comprises a connector body mounted on a mother board, the connector body comprising an elongated insertion slot longitudinally disposed at one side; two rows of terminals symmetrically mounted in the elongated insertion slot of the connector body at two opposite sides and soldered to the electric circuit of the mother board and adapted for electrically connecting an inserted memory module to the mother board; two latches integrally molded on the connector body and respectively extended from two opposite ends of the connector body at right angles in one direction, the latches each comprising a receptacle integral with one end of the connector body, and an inwardly extended and smoothed curved retainer block adapted for engaging into a respective retaining notch of a memory module being inserted into the insertion slot of the connector body; and two reinforcing members respectively fastened to the latches, the reinforcing members each comprising a plug strip plugged into the receptacle of one latch, an upwardly extended stop strip hooked on one latch at an inner side, a springy pressure strip pressed on one latch at an outer side against the stop strip, and a mounting strip soldered to the mother board.

DETAILED DESCRIPTION OF THE PREFERRED EMBODIMENT

Figure 1:
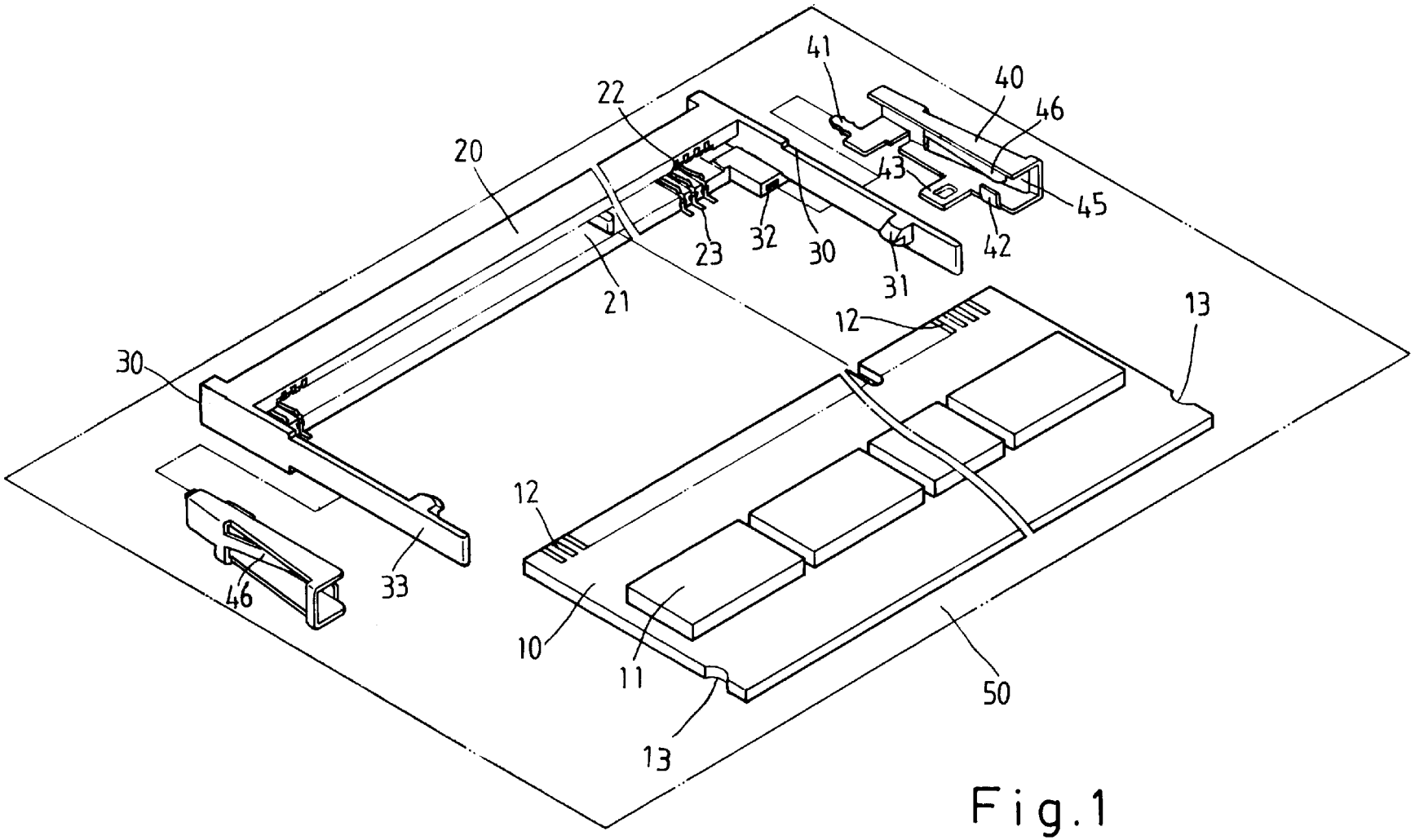
FIG. 1 is an exploded view of the preferred embodiment of the present invention.
Figure 2:
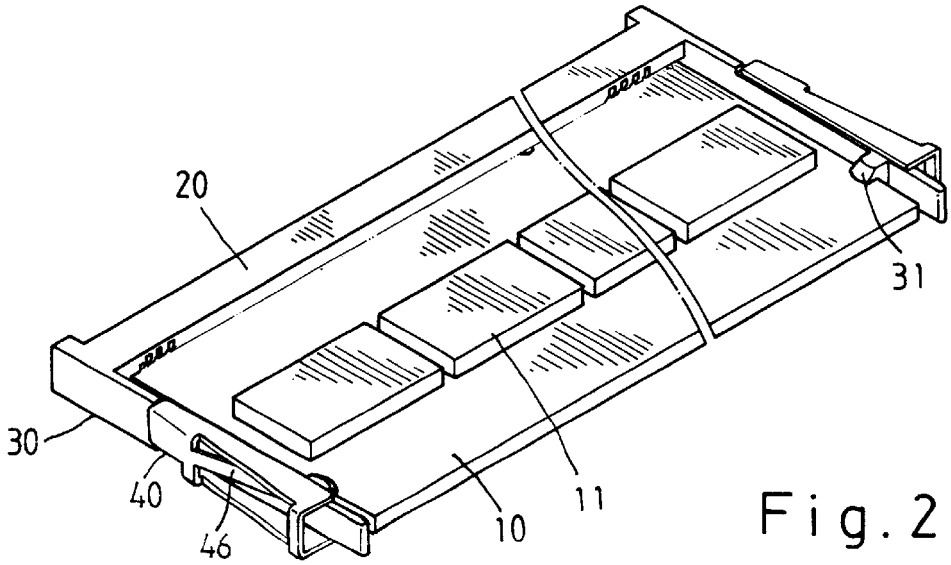
FIG. 2 is a perspective view of the present invention, showing the reinforcing members fastened to the latched at two opposite ends of the connector body.
Figure 3:
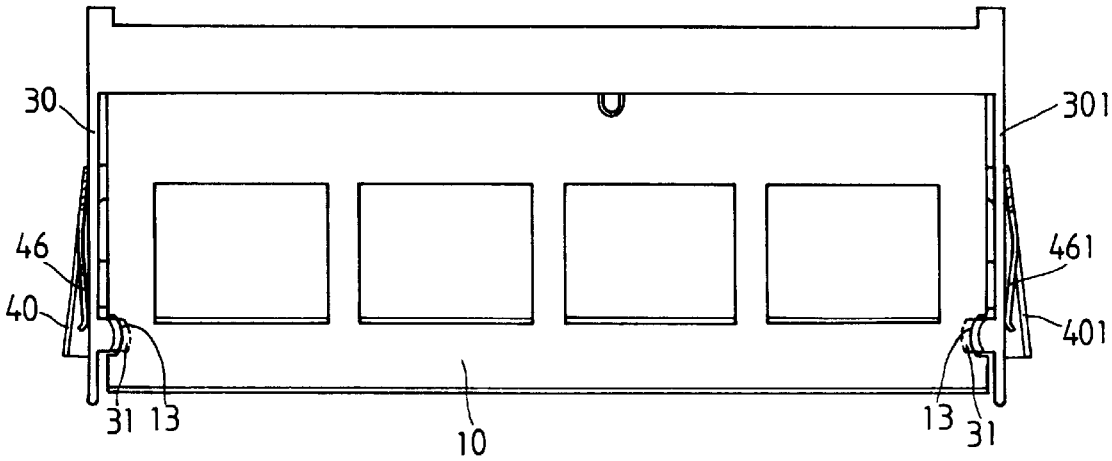
FIG. 3 is a top view of the present invention, showing the memory module obliquely inserted into the insertion slot of the connector body and the latched forced outwards.

Referring to FIGS. 1 and 2, a memory module connector in accordance with the present invention is adapted for connecting a memory module 10 to a mother board 50, and comprised of an elongated connector body 20, two latches 30 at two opposite ends of the connector body 20, and two reinforcing members 40 adapted for fastening to the latches 30. The connector body 20 and the latches 30 are molded from plastics in integrity. The reinforcing members 40 are made from metal.

Referring to FIG. 1 again, the memory module 10 is a flat, rectangular circuit board holding a plurality of random access memories 11 on a top side thereof, having two retaining notches 13 at two opposite short sides thereof and a row of contacts 12 arranged along one long side thereof.

Figure 2A:
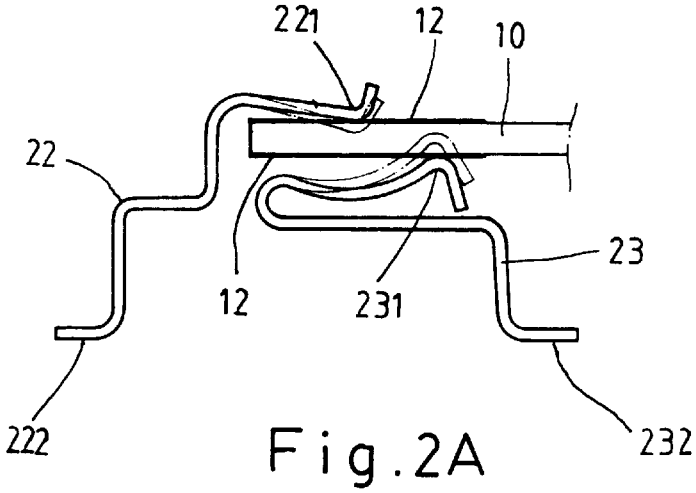
FIG. 2A is an enlarged view of a part of the present invention, showing the contacts of the inserted memory module retained between the contact tips of the terminals.

Referring to FIG. 2A and FIGS. 1 and 2 again, the connector body 20 comprises an elongated insertion slot 21 longitudinally disposed at one side and adapted for receiving the memory module 10, and two rows of terminals 22;23 symmetrically mounted in the elongated insertion slot 21 at two opposite sides and adapted for contacting the contacts 12 of the memory module 10. The terminals 22;23 have a respective contact tip 221;231 at one end adapted to contact the contacts 12 of the memory module 10 respectively, and a respective mounting tip 222;232 at an opposite end adapted for fastening to the mother board 50 by a surface mounting technique. The mounting tips 222;232 of the terminals 22;23 are disposed in parallel to the mother board 50 so that they can be fastened to one side of the mother board 50 and electrically connected to the electric circuit of the mother board 50.

Referring to FIGS. 1 and 2, the latches 30 are respectively extended from two opposite ends of the connector body 20 at right angles in one direction and arranged in parallel. Each latch 30 comprises a receptacle 32 integral with one end of the connector body 20 and adapted for holding one reinforcing member 40, and an inwardly extended and smoothed curved retainer block 31 adapted for engaging into one retaining notch 13 of the memory module 10.

Referring to FIGS. 1 and 2 again, the reinforcing members 40 are respectively mounted on the latches 30 and fastened to the receptacles 32 to reinforce the structural strength of the latches 30. Each reinforcing member 40 comprises a bilaterally serrated plug strip 41 extended from its rear end and adapted for engaging into the receptacle 32 of one latch 30, an upwardly extended stop strip 42 extended from the bottom side of its front end and adapted for hooking on one latch 30 from the bottom side, a mounting strip 43 disposed at its bottom side between the plug strip 41 and the stop strip 42 in parallel to the mother board 50 and adapted for fastening to the mother board 50 by soldering, an elongated slot 45, and a springy pressure strip 46 extended from one end of the elongated slot 45 and adapted to press on an outer side 33 of one latch 30 against the stop strip 42.

Referring to Figures from 3 to 5, when the reinforcing members 40 are respectively mounted around the latches 30 at two opposite ends of the connector body 20, the plug strips 41 of the reinforcing members 40 are respectively plugged into the receptacles 32 of the latches 30, the stop strips 42 and pressure strips 46 of the reinforcing members 40 are respectively stopped at the latches 30 at two opposite sides. After the reinforcing members 40 have been respectively fastened to the latches 30 at two opposite ends of the connector body 20, the mounting strips 43 of the latches 30 and the mounting tips 222;232 of the terminals 22;23 are respectively soldered to the mother board 50, then the memory module 10 is obliquely inserted into the insertion slot 21 of the connector body 20 between the latches 30 and then turned downwards and then pushed forwards into position. When the memory module 10 is turned downwards, the retainer blocks 31 of the latches 30 are forced outwards in reversed directions, for permitting the memory module 10 to be set into position. Because the latches 30 are protected by the metal reinforcing members 40, they are prohibited by the metal reinforcing members 40 from being excessively bent or deformed. After the memory module 10 has been set into position with its contacts 12 respectively retained between the contact tips 221;231 of the terminals 22;23, the retainer blocks 31 of the latches 30 are forced by the spring power of the material property of the latches 30 into engagement with the retaining notches 13 of the memory module 10, and therefore the memory module 10 is firmly retained in place and electrically connected to the electric circuit of the mother board 50 by the terminals 22;23.

Figure 4:
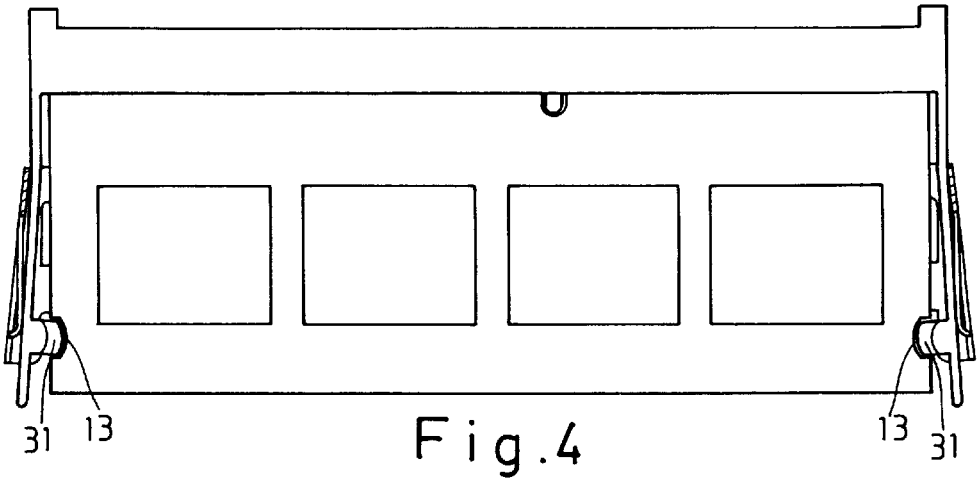
FIG. 4 is similar to FIG. 3 but showing the memory module turned downwards.
Figure 5:
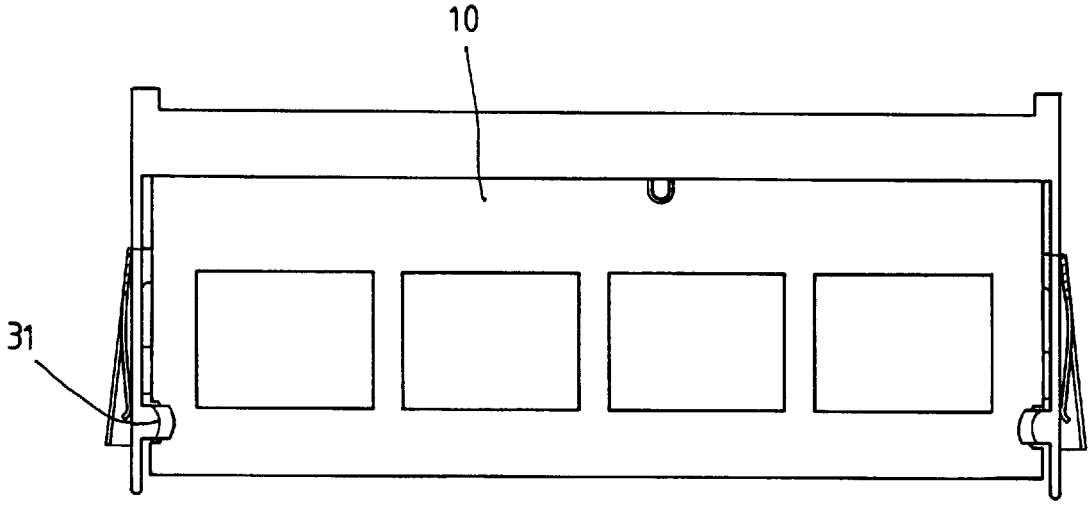
FIG. 5 is similar to FIG. 4 but showing the retainer blocks of the latches respectively forced into engagement with the retaining notches of the inserted memory module.
Figure 6:
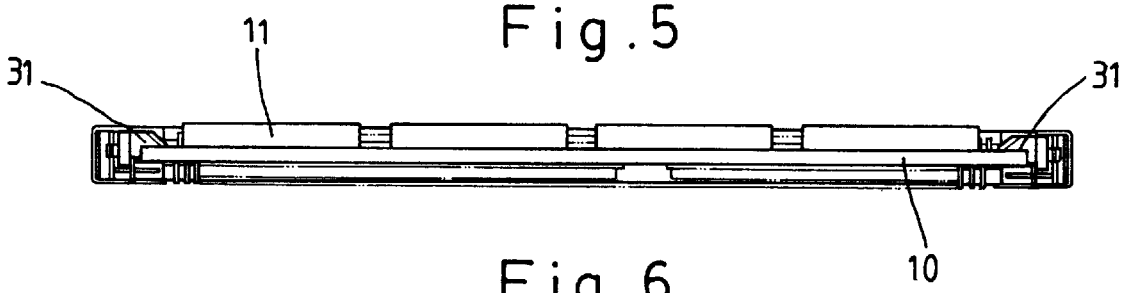
FIG. 6 is a front view of FIG. 5.

When to disconnect the memory module 10 from the memory module connector 20, the latches 30 are bent outwards. When the latches 30 are bilaterally bent outwards as shown in FIG. 4, they are supported by the rigid metal reinforcing members 30 (because the plug strips 41 of the reinforcing members 40 are respectively fastened to the receptacles 32 which are integral with the two opposite ends of the connector body 20) and prohibited from being excessively bent outwards. When the retainer blocks 31 are respectively moved outwards with the latches 20 and disengaged from the retaining notches 13 of the memory module 10, the memory module 10 is immediately forced outwards from the insertion slot 21 of the connector body 20 by the spring power of the material property of the terminals 22;23, and thus the memory module 10 can be directly removed from the memory module connector 20.

While only one embodiment of the present invention has been shown and described, it will be understood that various modifications and changes could be made thereunto without departing from the spirit and scope of the invention disclosed.

What the invention claimed is:

1. A memory module connector mounted on a mother board and adapted to receive a memory module, comprising:

a connector body, said connector body comprising an elongated insertion slot disposed at one side;

two rows of terminals mounted in the elongated insertion slot of said connector body at two opposite sides and adapted for electrically connecting an inserted memory module to said mother board;

two flexible latches extended from two opposite ends of said connector body at right angles in one direction and arranged in parallel, said latches each comprising a receptacle integral with one end of said connector body, and an inwardly extended and smoothed curved retainer block adapted for engaging into a respective retaining notch of a memory module being inserted into the insertion slot of said connector body; and two reinforcing members, each said reinforcing member extending along an outer side of and fastened to one of said latches so that said reinforcing members cover a flexing area of said latches, said reinforcing members each comprising a plug strip plugged into the receptacle of one latch, an upwardly extended stop strip hooked on one latch at an inner side, a springy pressure strip pressed on one latch at an outer side against said stop strip, and a mounting strip soldered to said mother board.

2. The memory module connector of claim 1, wherein said latches are integrally molded from plastics on two opposite ends of said connector body.

3. The memory module connector of claim 1, wherein said reinforcing members are made from metal.

4. The memory module connector of claim 1, wherein said terminals have a respective contact tip at one end adapted to contact said contacts of said memory module respectively, and a respective mounting tip at an opposite end adapted for fastening to a mother board by a surface mounting technique, the mounting tips of said terminals being disposed in parallel to said mother board and respectively soldered to the electric circuit of said mother board.

5. The memory module of claim 1, wherein the plug strip of each of said latches has two opposite sides serrated.

* * * * *